US011708745B2

(12) United States Patent
Gravois

(10) Patent No.: US 11,708,745 B2
(45) Date of Patent: Jul. 25, 2023

(54) METHOD FOR INCORPORATING SCRAPERS IN MULTI ZONE PACKER ASSEMBLY

(71) Applicant: Halliburton Energy Services, Inc., Houston, TX (US)

(72) Inventor: Kyle Patrick Gravois, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 17/186,386

(22) Filed: Feb. 26, 2021

(65) Prior Publication Data

US 2021/0262317 A1 Aug. 26, 2021

Related U.S. Application Data

(60) Provisional application No. 62/982,014, filed on Feb. 26, 2020.

(51) Int. Cl.
*E21B 37/04* (2006.01)
*E21B 23/06* (2006.01)
*E21B 23/03* (2006.01)

(52) U.S. Cl.
CPC ..... *E21B 37/04* (2013.01); *E21B 23/03* (2013.01); *E21B 23/06* (2013.01)

(58) Field of Classification Search
CPC ..... E21B 37/02; E21B 37/04; E21B 37/045; E21B 23/03; E21B 23/06
See application file for complete search history.

(56) References Cited

U.S. PATENT DOCUMENTS 3,608,633 A * 9/1971 Talley, Jr. ..... B08B 9/0553 166/170
4,662,450 A * 5/1987 Haugen ..... E21B 23/065 166/299
4,703,804 A * 11/1987 Stokes ..... E21B 37/02 166/173
5,577,559 A 11/1996 Voll et al.
2001/0040035 A1* 11/2001 Appleton ..... E21B 37/02 166/173
2020/0332625 A1* 10/2020 Howitt ..... E21B 37/02

FOREIGN PATENT DOCUMENTS

GB 2374619 A 10/2002

* cited by examiner

*Primary Examiner* — D. Andrews
(74) *Attorney, Agent, or Firm* — Scott Richardson; Parker Justiss, P.C.

(57) ABSTRACT

Provided is a method for deploying a multi-zone completion assembly, as well as a downhole tool and a well system. In one aspect, the method for deploying the multi-zone completion assembly includes coupling a casing scraper assembly to an inner service tool string hanging from a beginning section of a packer assembly suspended from a rig floor, the inner service tool string located within and extending below the beginning section of the packer assembly, and the casing scraper assembly located entirely below the beginning section of the packer assembly string. In one or more other aspects, the method includes completing the packer assembly string from the rig floor as the inner service tool string and casing scraper assembly are hanging therefrom.

19 Claims, 7 Drawing Sheets

METHOD FOR INCORPORATING SCRAPERS IN MULTI ZONE PACKER ASSEMBLY

CROSS-REFERENCE TO RELATED APPLICATION

Figure 1:
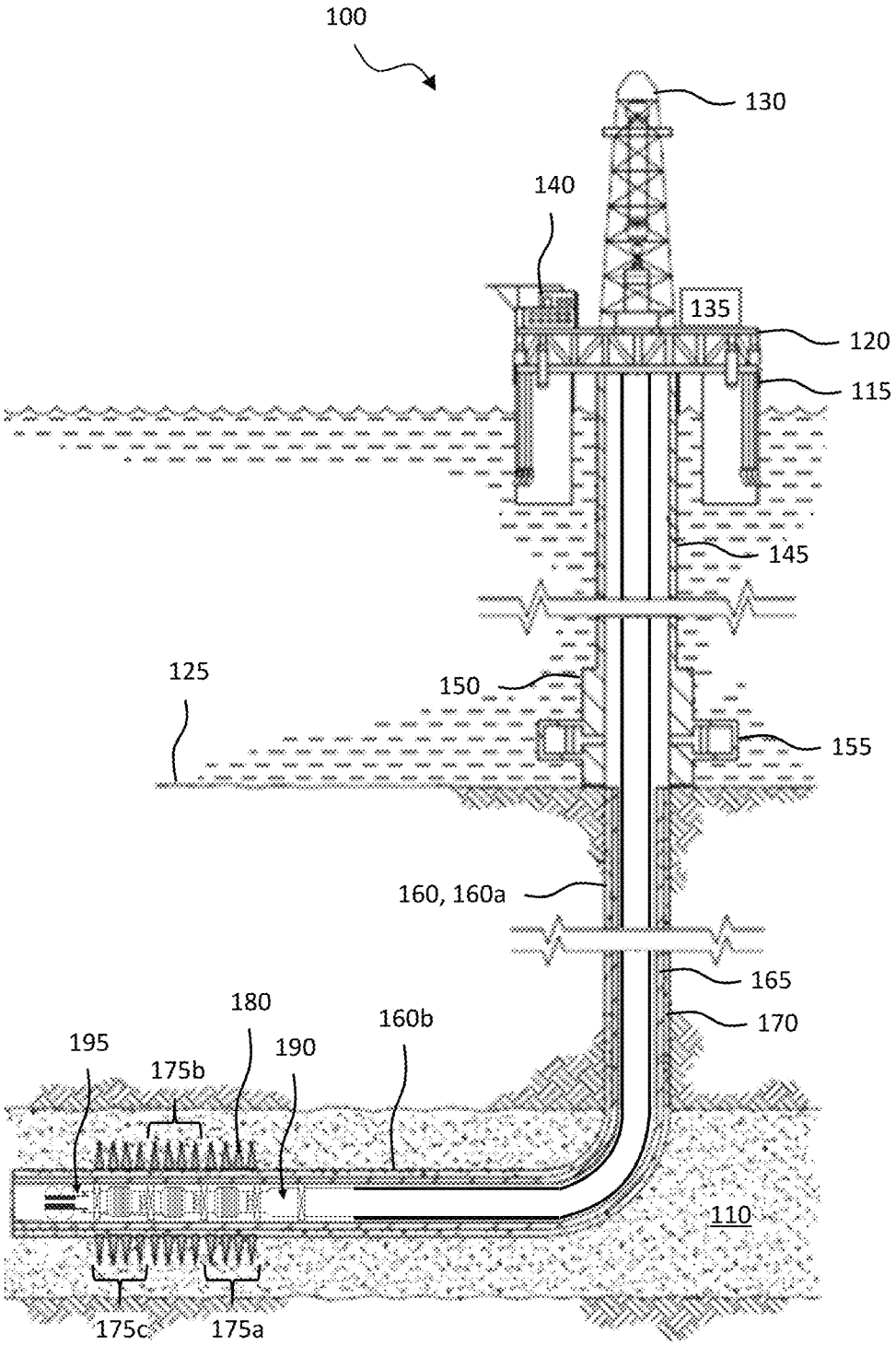

This application claims the benefit of U.S. Provisional Application Ser. No. 62/982,014, filed on Feb. 26, 2020, entitled "METHOD FOR INCORPORATING SCRAPERS IN MULTI ZONE PACKER ASSEMBLY," commonly assigned with this application and incorporated herein by reference in its entirety.

BACKGROUND

In the production of oil and gas, wells can reach as much as 31,000 feet or more below the ground or subsea surface. In addition, offshore wells may be drilled in water exhibiting depths of as much as 10,000 feet or more. Accordingly, the total depth from an offshore drilling vessel to the bottom of a drilled wellbore can thus be in excess of six miles. Such extraordinary distances in modern well construction cause significant challenges in equipment, drilling, and servicing operations.

It may take many days for a wellbore service string to make a "trip" into a wellbore, which may be due in part to the time-consuming practice of making and breaking pipe joints to reach the desired depth. Moreover, the time required to assemble and deploy a service tool assembly downhole for such a long distance is very time consuming and costly. Since the cost per hour to operate a drilling or production rig is very expensive, saving time and steps can be hugely beneficial in terms of cost-savings in well service operations. Each trip into the wellbore adds expense and increases the possibility that tools may become lost in the wellbore, thereby requiring still further operations for their retrieval. Moreover, each additional trip into the wellbore oftentimes has the effect of reducing the inner diameter of the wellbore, which restricts the size of tools that are able to be introduced into the wellbore past such points.

To enable the fracturing and/or gravel packing of multiple hydrocarbon-producing zones in reduced timelines and to save trips, some oil service providers have developed "single trip" multi-zone systems. Single trip multi-zone completion technology enables operators to perforate a large wellbore interval at one time, then make a clean-out trip and run all of the screens and packers at one time, thereby minimizing the number of trips into the wellbore and rig days required to complete conventional fracture and gravel packing operations in multiple pay zones.

It is often necessary or desirable to remove debris or other irregularities along the inner surfaces of the well. For example, after a casing (or other wellbore tubular) is perforated, it is typically desirable to remove burrs, jagged edges, and/or other irregularities inside the casing prior to the installation of the multi-zone completion technology. Debris or burrs on the inside of the casing may obstruct insertion and/or removal of the multi-zone completion technology. Such irregularities may also damage components of the multi-zone completion technology during run-in. For example, elastomeric packers of the multi-zone completion technology may be cut by a burr or jagged edge when lowered into the well through the casing, which may prevent the packers from sealing properly upon operation. Current tools for removing debris or burrs are generally inflexible during operation and have many drawbacks, particularly when used with the multi-zone completion technology.

BRIEF DESCRIPTION

Figure 2:
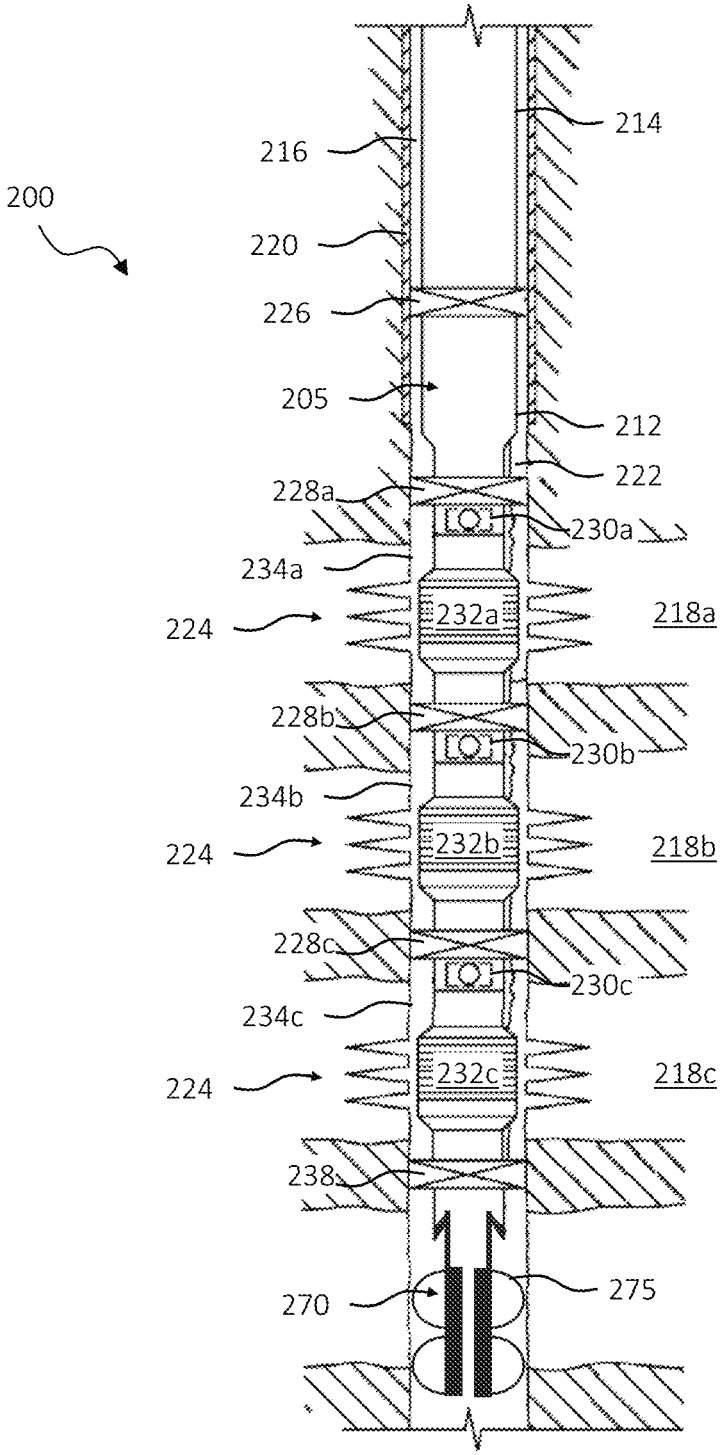

Reference is now made to the following descriptions taken in conjunction with the accompanying drawings, in which:

FIG. 1 illustrates a well system, including a multi-zone completion assembly and a casing scraper assembly, designed, manufactured and run according to the present disclosure;

FIG. 2 illustrates a downhole tool including a multi-zone completion assembly having a casing scraper assembly coupled to a downhole end thereof according to one or more embodiments of the present disclosure; and FIGS. 3A-3E illustrate a process flow for deploying a downhole tool including a multi-zone completion assembly and casing scraper assembly designed, manufactured and operated according to the disclosure.

DETAILED DESCRIPTION

The present disclosure provides an apparatus and method for the conveyance of a wellbore casing scraper assembly below a multi-zone completion assembly, for the purpose of removing the aforementioned debris and/or burrs prior to the multi-zone completion assembly encountering them. In one example, a wellbore casing scraper assembly would be hung from the multi-zone completion assembly, such as at the bottom of an Enhanced Single-Trip Multizone Completion System (ESTMZ), which is marketed by Halliburton Energy Services, Inc. of Houston, Tex. USA. In one example, the wellbore casing scraper assembly would be hung from the multi-zone completion assembly, for example using a latch plug receptacle coupled to a downhole end of the multi-zone completion assembly, and a latch plug assembly coupled to an uphole end of the wellbore casing scraper assembly. This allows the inner service tool string of the multi-zone completion assembly to be picked up at the rig floor following the standard multi-zone completion technology procedures, with no ID interference issues. When the inner service tool string is pulled uphole within the multi-zone completion assembly, as is often performed under the standard multi-zone completion technology procedures, the latch plug assembly would engage the corresponding latch plug receptacle located in the multi-zone completion assembly, mating the wellbore casing scraper assembly with the multi-zone completion assembly. This process places the scrapers of the wellbore casing scraper assembly below the lowermost packer of the multi-zone completion assembly, thus providing the ability to de-burr the wellbore casing prior to any packer assembly passing the perforations. Such an apparatus and method will allow the user to remove a dedicated de-burr run, which reduces the associated costs of drilling the well.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Referring initially to FIG. 1, schematically illustrated is a well system 100, including a multi-zone completion assembly 190 including a casing scraper assembly 195 designed, manufactured and run according to the present disclosure, and positioned at a desired location in a subterranean formation 110. The well system 100 of FIG. 1, without limitation, includes a semi-submersible platform 115 having a rig floor 120 positioned over the submerged oil and gas formation 110, which in this embodiment is located below sea floor 125.

The semi-submersible platform 115, in the illustrated embodiment, may include a hoisting apparatus/derrick 130 for raising and lowering work string, including the multi-zone completion assembly 190 and the casing scraper assembly 195, as well as a fracturing pump 135 for conducting a fracturing process of the subterranean formation 110 according to the disclosure. The well system 100 illustrated in FIG. 1 may additionally include a control system 140 located on the rig floor 120. The control system 140, in one embodiment, may be used to control the fracturing pump 135, as well as may be communicatively, e.g., electrically, electromagnetically or fluidly, coupled to multi-zone completion assembly 190 including the casing scraper assembly 195, among other uses.

In the embodiment of FIG. 1, a subsea conduit 145 extends from the platform 115 to a wellhead installation 150, which may include one or more subsea blow-out preventers 155. A wellbore 160 extends through the various earth strata including the subterranean formation 110. In the embodiment of FIG. 1, wellbore casing 165 is cemented within wellbore 160 by cement 170. In at least one embodiment, the wellbore 160 includes a cased-hole region and an open-hole region. Nevertheless, other embodiments may exist wherein the wellbore is entirely cased.

In the illustrated embodiment, the wellbore 160 has an initial, generally vertical portion 160*a* and a lower, generally deviated portion 160*b*, which is illustrated as being horizontal. It should be noted, however, that multi-zone completion assembly 190 including the casing scraper assembly 195 of the present disclosure is equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, the principles of the present disclosure are equally as applicable to other subterranean formations, including those encompassing both areas below exposed earth and areas below earth covered by water such as ocean or fresh water.

In accordance with one embodiment of the disclosure, the multi-zone completion assembly 190 includes the casing scraper assembly 195 coupled to a downhole end thereof. As discussed above, the casing scraper assembly 195 is operable to remove debris and burrs from the wellbore casing 165 (e.g., that may have been created during the wellbore casing perforation process) prior to the multi-zone completion assembly 190 encountering the debris and burrs.

When it is desired to fracture a particular subterranean zone of interest, such as fracturing zones of interest 175*a*, 175*b*, 175*c* the multi-zone completion assembly 190 may be appropriately actuated, for example by moving the inner service tool string of the multi-zone completion assembly 190 within the packer assembly string of the multi-zone completion assembly 190, thus opening and closing certain fracturing port covers/sleeves. Thereafter, pressure within the wellbore 160 may be increased using the fracturing pump 135 and one or more different types of fracturing fluid and/or proppants, thereby forming fractures 180.

Turning to FIG. 2, illustrated is one embodiment of a downhole tool 200 including a multi-zone completion assembly 205 (e.g., single trip multi-zone completion assembly) and casing scraper assembly 270 designed, manufactured and operated according to one or more embodiments of the disclosure. In the illustrated embodiment, the multi-zone completion assembly 205 may include an outer completion string 212 that may be coupled to a work string 214 configured to extend longitudinally within a wellbore 216. The wellbore 216 may penetrate multiple subterranean formation zones 218*a*, 218*b*, and 218*c*, and the outer completion string 212 may be extended into the wellbore 216 until being arranged or otherwise disposed generally adjacent the formation zones 218*a-c*. The formation zones 218*a-c* may be portions of a common subterranean formation or hydrocarbon-bearing reservoir. Alternatively, one or more of the formation zones 218*a-c* may be portion(s) of separate subterranean formations or hydrocarbon-bearing reservoirs. The term "zone" as used herein, however, is not limited to one type of rock formation or type, but may include several types, without departing from the scope of the disclosure.

As will be discussed in greater detail below, the outer completion string 212 may be deployed within the wellbore 216 in a single trip and used to hydraulically fracture ("frac") and gravel pack the various formation zones 218*a-c*, and subsequently intelligently regulate hydrocarbon production from each production interval or formation zone 218 *a-c*. Although only three formation zones 218*a-c* are depicted in FIG. 2, it will be appreciated that any number of formation zones 218*a-c* (including one) may be treated or otherwise serviced using the multi-zone completion assembly 205, without departing from the scope of the disclosure.

As depicted in FIG. 2, portions of the wellbore 216 may be lined with wellbore casing 220 and properly cemented therein, as known in the art. The remaining portions of the wellbore 216, including the portions encompassing the formation zones 218*a-c*, may be an open hole section 222 of the wellbore 216 and the outer completion string 212 may be configured to be generally arranged therein during operation. As will be discussed in more detail below, several fractures 224 may be initiated at or in each formation zone 218*a-c* and configured to provide fluid communication between each respective formation zone 218*a-c* and the annulus formed between the outer completion string 212 and walls of the open hole section 222. Particularly, a first annulus 234*a* may be generally defined between the first formation zone 218*a* and the outer completion string 212. Second and third annuli 234*b* and 234*c* may similarly be defined between the second and third formation zones 218*b* and 218*c*, respectively, and the outer completion string 212.

The outer completion string 212 may have a top packer 226 including slips (not shown) configured to support the outer completion string 212 within the casing 220 when properly deployed. In some embodiments, the top packer 226 may be a VERSA-TRIEVE® hangar packer commercially available from Halliburton Energy Services of Houston, Tex., USA. Disposed below the top packer 226 may be one or more isolation packers 228 (three shown), one or more circulating sleeves 230 (three shown in dashed), and one or more sand screens 232 (three shown). Specifically, arranged below the top packer 226 may be first isolation packer 228*a*, a first circulating sleeve 230*a* (shown in dashed), and a first sand screen 232*a*. A second isolation packer 228*b* may be disposed below the first sand screen 232*a*, and a second circulating sleeve 230*b* (shown in dashed) and a second sand screen 232*b* may be disposed below the second isolation packer 228*b*. A third isolation packer 228*c* may be disposed below the second sand screen 232*b*, and a third circulating sleeve 230*c* (shown in dashed) and a third sand screen 232*c* may be disposed below the third isolation packer 228*c*.

Each circulating sleeve 230*a-c* may be movably arranged within the outer completion string 212 and configured to axially translate between open and closed positions. Although described herein as movable sleeves, those skilled in the art will readily recognize that each circulating sleeve 230*a-c* may be any type of flow control device known to those skilled in the art, without departing from the scope of the disclosure. First, second, and third ports may be defined in the outer completion string 212 at the first, second, and third circulating sleeves 230*a-c*, respectively. When the circulating sleeves 230*a-c* are moved into their respective open positions, the ports are opened or otherwise incrementally exposed and may thereafter provide fluid communication between the interior of the outer completion string 212 and the corresponding annuli 234*a-c*.

Each sand screen 232*a-c* may include a corresponding flow control device (not shown as under the sand screens 232*a-c*) movably arranged therein and also configured to axially translate between open and closed positions. In some embodiments, each flow control device may be characterized as a sleeve, such as a sliding sleeve that is axially translatable within its associated sand screen 232*a-c*. As will be discussed in greater detail below, each flow control device may be moved or otherwise manipulated in order to facilitate fluid communication between the formation zones 218*a-c* and the outer completion string 212 via its corresponding sand screen 232*a-c*.

The casing scraper assembly 270, in the illustrated embodiment, is coupled to a downhole end of the multi-zone completion assembly 205. In at least one embodiment, the casing scraper assembly 270 includes one or more radially deployable casing scrapers 275. For example, in one or more embodiments, the radially deployable casing scrapers 275 are spring loaded casing scrapers. In accordance with the disclosure, as the multi-zone completion assembly 205 and casing scraper assembly 270 are deployed within the wellbore casing 220, the casing scraper assembly 270 removes debris and burrs from the wellbore casing 220. As the casing scraper assembly 270 is positioned downhole of the multi-zone completion assembly 205, the casing scraper assembly 270 removes the debris and burrs from the wellbore casing 220 (e.g., that may have been created during the wellbore casing perforation process) prior to the multi-zone completion assembly 205 encountering the debris and burrs.

Upon properly aligning the sand screens 232*a-c* with the corresponding production zones 218*a-c*, the top packer 226 may be set within the casing 220, thereby anchoring or otherwise suspending the outer completion string 212 within the open hole section 222 of the wellbore 216. The isolation packers 228*a-c* and a bottom packer 238 may also be set at this time, thereby defining individual production intervals corresponding to the various formation zones 218*a-c*. As illustrated, the bottom packer 238 may be set within the wellbore 216 below the third formation zone 218*c* and the third sand screen 232*c*. The bottom packer 238 may be, for example, an open hole packer that acts as a sump packer, as generally known in the art. The work string 214 may then be detached from the top packer 226 and removed from the well, along with any accompanying setting tools and/or devices.

While not shown, an inner service tool string, also known as a gravel pack service tool, is positioned within the outer completion string 212 on a work string (not shown) made up of drill pipe or tubing. The inner service tool string, in at least one embodiment, is positioned in the first zone to be treated, e.g., the third production interval or formation zone 218*c*. The inner service tool string may include one or more shifting tools (not shown) used to open and/or close the circulating sleeves 230*a-c* and the flow control devices. In some embodiments, for example, the inner service tool string has two shifting tools arranged thereon or otherwise associated therewith; one shifting tool configured to open the circulating sleeves 230*a-c* and the flow control devices, and a second shifting tool configured to close the circulating sleeves 230 *a-c* and flow control devices. In other embodiments, more or less than two shifting tools may be used, without departing from the scope of the disclosure. In yet other embodiments, the shifting tools may be omitted entirely from the inner service tool string and instead the circulating sleeves 230 *a-c* and flow control devices may be remotely actuated, such as by using actuators, solenoids, pistons, and the like.

Before producing hydrocarbons from the various formation zones 218*a-c* penetrated by the outer completion string 212, each formation zone 218*a-c* may be hydraulically fractured in order to enhance hydrocarbon production, and each annulus 234*a-c* may be gravel packed to ensure limited sand production into the outer completion string 212 during production. The fracturing and gravel packing processes for the outer completion string 212 may be accomplished sequentially or otherwise in step-wise fashion for each individual formation zone 218*a-c*, starting from the bottom of the outer completion string 212 and proceeding in an uphole direction. In one embodiment, for example, the third production interval or formation zone 218*c* may be fractured and the third annulus 234*c* may be gravel packed prior to proceeding to the second and first formation zones 218*b* and 218*a*, in sequence. The third annulus 234*c* may be defined generally between the bottom packer 238 and the third isolation packer 228*c*. The one or more shifting tools may be used to open the third circulating sleeve 230*c* and the third flow control device disposed within the third sand screen 232*c*. In other embodiments, however, the third circulation sleeve 230*c* and flow control device may have already been opened either at the surface or at another point during the deployment process in the wellbore 216.

A fracturing fluid may then be pumped down the work string and into the inner service tool string. In some embodiments, the fracturing fluid may include a base fluid, a viscosifying agent, proppant particulates (including a gravel slurry), and one or more additives, as generally known in the art. The incoming fracturing fluid may be directed out of the outer completion string 212 and into the third annulus 234*c* via the third port 236*c*. Continued pumping of the fracturing fluid forces the fracturing fluid into the third formation zone 218*c*, thereby creating or enhancing the fractures 224 and extending a fracture network into the third formation zone 218*c*. The accompanying proppant serves to support the fracture network in an open configuration. The incoming gravel slurry builds in the annulus 234*c* between the bottom packer 238 and the third isolation packer 228*c* and the particulates therein begin to form what is referred to as a "sand face" pack. The sand face pack, in conjunction with the third sand screen 232*c*, serves to prevent the influx of sand or other particulates from the third formation zone 218*c* into the outer completion string 212 during production operations.

Once a desired net pressure is built up in the third formation zone 218*c*, the fracturing fluid injection rate is stopped. The inner service tool is then axially moved to position in the reverse position and a return flow of fracturing fluid flows through the work string 214 in order to reverse out any excess proppant that may remain in the work string 214. When the proppant is successfully reversed, the third circulating sleeve 230*c* and the third flow control device are closed using the one or more shifting tools, and the third annulus 234*c* is then pressure tested to verify that the corresponding circulating sleeve 230*c* and flow control device are properly closed. At this point, the third formation zone 218*c* has been successfully fractured and the third annulus 234*c* has been gravel packed.

The inner service tool string (e.g., gravel pack service tool) may then be axially moved within the outer completion string 212 to locate the second formation zone 218*b* and the first formation zone 218*a*, successively, where the foregoing process is repeated in order to fracture the first and second formation zones 218*a, b* and gravel pack the first and second annuli 234*a, b*. The second annulus 234*b* may be generally defined axially between the second and third isolation packers 228*b, c*. Upon locating the second production interval or formation zone 218*b*, the one or more shifting tools may be used to open the second circulating sleeve 230*b* and the second flow control device. Again, the second circulating sleeve 230*b* and flow control device may have been opened prior to this point or at any other point during the deployment process, without departing from the scope of the disclosure. Fracturing fluid may then be pumped into the second annulus 234*b* via the second port 236*b*. The injected fracturing fluid fractures the second formation zone 218*b*, and the gravel slurry adds to the sand face pack in the second annulus 234*b* between the second isolation packer 228*b* and the third isolation packer 228*c*.

Once the second annulus 234*b* is pressure tested, the inner service tool may then be axially moved to locate the first formation zone 218*a* and again repeat the foregoing process. The first annulus 234*a* may be generally defined between the first and second isolation packers 228*a, b*. Upon locating the first production interval or formation zone 218*a*, the one or more shifting tools may be used to open the first circulating sleeve 230*a* and flow control device (or they may be opened remotely, as described above), and fracturing fluid is pumped into the first annulus 234*a* via the first port 236*a*. The injected fracturing fluid creates or enhances fractures in the first formation zone 218*a*, and the gravel slurry adds to the sand face pack in the first annulus 234*a* between the first and second isolation packers 228*a, b*. Once the first annulus 234*a* is pressure tested, the inner service tool may be removed from the outer completion string 212 and the well altogether, with the circulation sleeves 230*a-c* and flow control devices being closed and providing isolation during installation of the remainder of the completion, as discussed below.

FIGS. 3A-3E illustrate a process flow for deploying a downhole tool 300 designed, manufactured and operated according to one or more embodiments of the disclosure. While note shown in detail, the downhole tool 300 could include many of the same features as the downhole tool 200 disclosed in the paragraphs above. The downhole tool 300, in one or more embodiments, includes a multi-zone completion assembly 305 having a casing scraper assembly 370 coupled thereto, each of the multi-zone completion assembly 305 and the casing scraper assembly 370 being designed, manufactured and operated according to one or more aspects of the disclosure. In the embodiments of FIGS. 3A-3E, the multi-zone completion assembly 305 is hanging from a rig floor 302 using a hoisting apparatus/derrick (not shown). In at least one embodiment, the rig floor 302 is that of a semi-submersible platform positioned over a body of water.

Figure 3A:
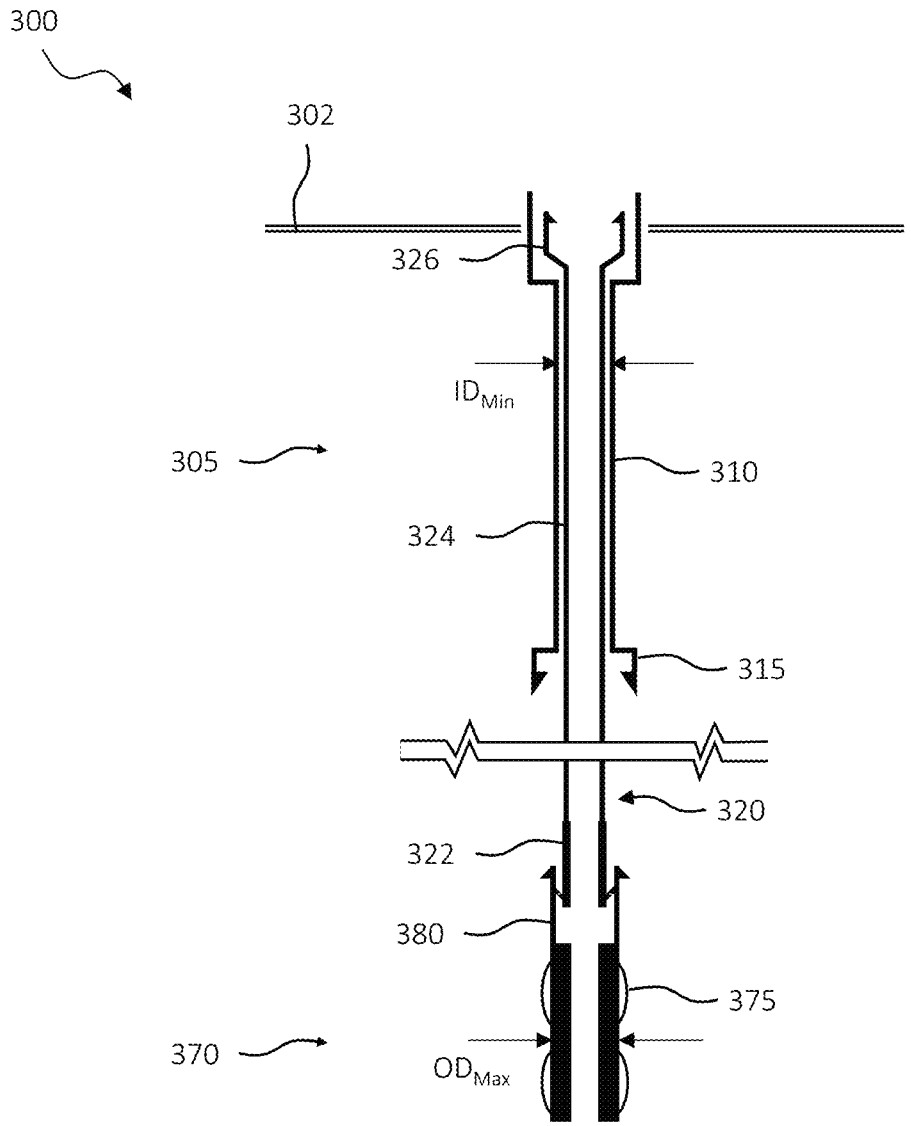

The multi-zone completion assembly 305 illustrated in FIG. 3A includes a beginning section of a packer assembly string 310. This beginning section of the packer assembly string 310 would likely be the downhole most section of the packer assembly string. In the embodiment of FIG. 3A, a downhole end of the beginning section of the packer assembly string 310 includes a packer assembly string latch 315. In at least one embodiment, the packer assembly string latch 315 is a latch plug receptacle. Nevertheless, any type of latch consistent with the disclosure could be used as the packer assembly string latch 315 and remain within the scope of the disclosure.

Hanging within the beginning section of the packer assembly string 310 in the embodiment of FIG. 3A is an inner service tool string 320. The inner service stool string 320, in the embodiment of FIG. 3A, includes an inner service tool 322, such as an ESTMZ™ service tool, a conveyance 324 (e.g., washpipe), and a suspension tool 326, all of which have been made-up and are hanging from the rig floor 302.

Coupled to a lower section of the inner service tool 322 is a casing scraper assembly 370. For example, in the embodiment of FIG. 3A, the casing scraper assembly 370 is coupled to or includes a casing scraper latch 380. In one or more embodiments of the disclosure, the casing scraper latch 380 is a latch plug assembly, and furthermore the lower section of the inner service tool 322 extends within and engages with an inside diameter (ID) of the latch plug assembly, thereby coupling the inner service tool 322 to the casing scraper assembly 370. In at least one embodiment, a maximum outside diameter ($OD_{Max}$) of the casing scraper assembly 370 is greater than a minimum inside diameter ($ID_{Min}$) of the packer assembly string 310. According to this embodiment, the casing scraper assembly 370 would need to be installed below the packer assembly string 310.

The casing scraper assembly 370 includes one or more casing scrapers 375. The one or more casing scrapers 375 may take on many different configurations and remain within the scope of the disclosure. In at least one embodiment, however, the one or more casing scrapers are one or more radially deployable casing scrapers. The term "radially deployable scrapers" as used herein is intended to mean that the one or more casing scrapers may radially extend or compress to adjust to the shape of the wellbore casing. Accordingly, the entire inner service tool string 320, including the inner service tool 322, the conveyance 324, and the suspension tool 326 suspend the casing scraper assembly 370 below a lowermost end of the packer assembly string 310.

To assemble the multi-zone completion assembly 305 illustrated in FIG. 3A, the beginning section to the packer assembly string 310 would initially be hung from the rig floor 302. Thereafter, beginning with the casing scraper assembly 370 (e.g., including the casing scraper latch 380) and inner service tool 322, the inner service tool string 320 components (e.g., conveyance 324 and suspension tool 326) would be picked up and sequentially coupled together at the rig floor 302, thereby resulting in a completed inner service tool string 320 having the casing scraper assembly 370 hanging therefrom. Accordingly, as shown in FIG. 3A, portions of the completed inner service tool string 320 and an entirety of the casing scraper assembly 370 would be hanging below the packer assembly string 310. In many embodiments, the casing scraper assembly 370 is not yet located within a wellbore, but for example could be hanging above the wellbore within a subsea conduit.

Figure 3B:
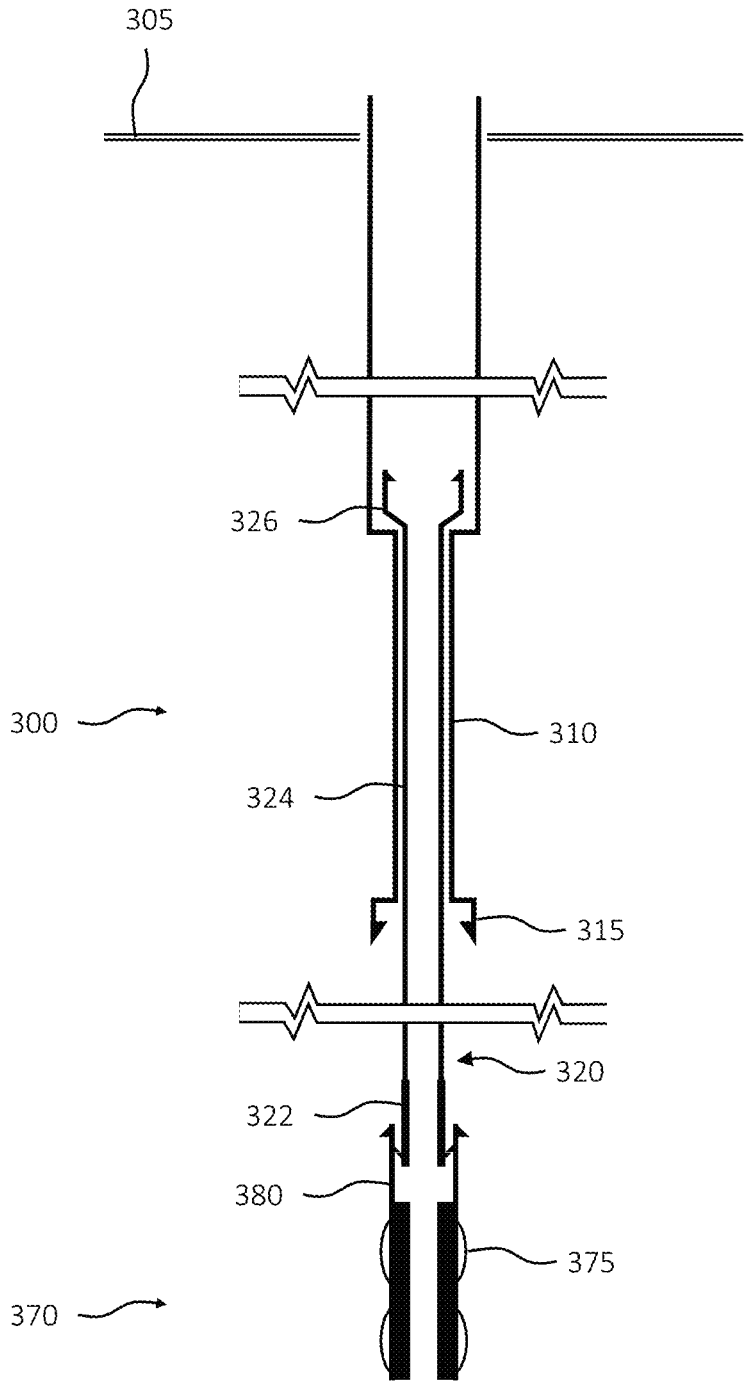

FIG. 3B illustrates the multi-zone completion assembly 305 of FIG. 3A after sequentially coupling together remaining sections of the packer assembly string 310. What now results is the completed packer assembly string 310 hanging from the rig floor 302, as well as the completed inner service tool string 320 and casing scraper assembly 370 hanging below the packing assembly string 310.

Figure 3C:
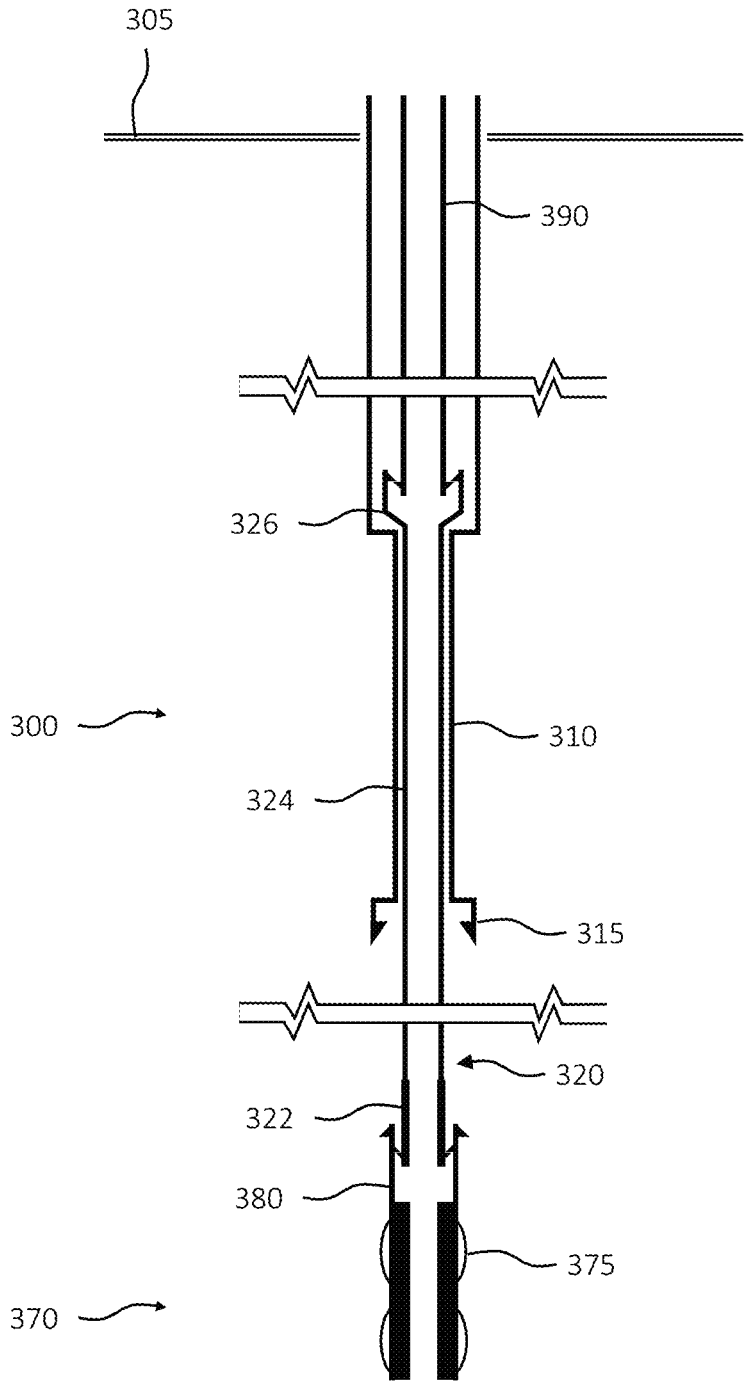

FIG. 3C illustrates the multi-zone completion assembly 305 of FIG. 3B after running a fishing tool 390 within the packer assembly string 310. The fishing tool 390, as illustrated in FIG. 3C, engages the inner service tool string 320, for example using the suspension tool 326, and thus may be used to pull the inner service tool string 320 uphole. At this stage, the completed inner service tool string 320 and casing scraper assembly 370 are still hanging below the packing assembly string 310, but the fishing tool 390 is coupled to the inner service tool string 320.

Figure 3D:
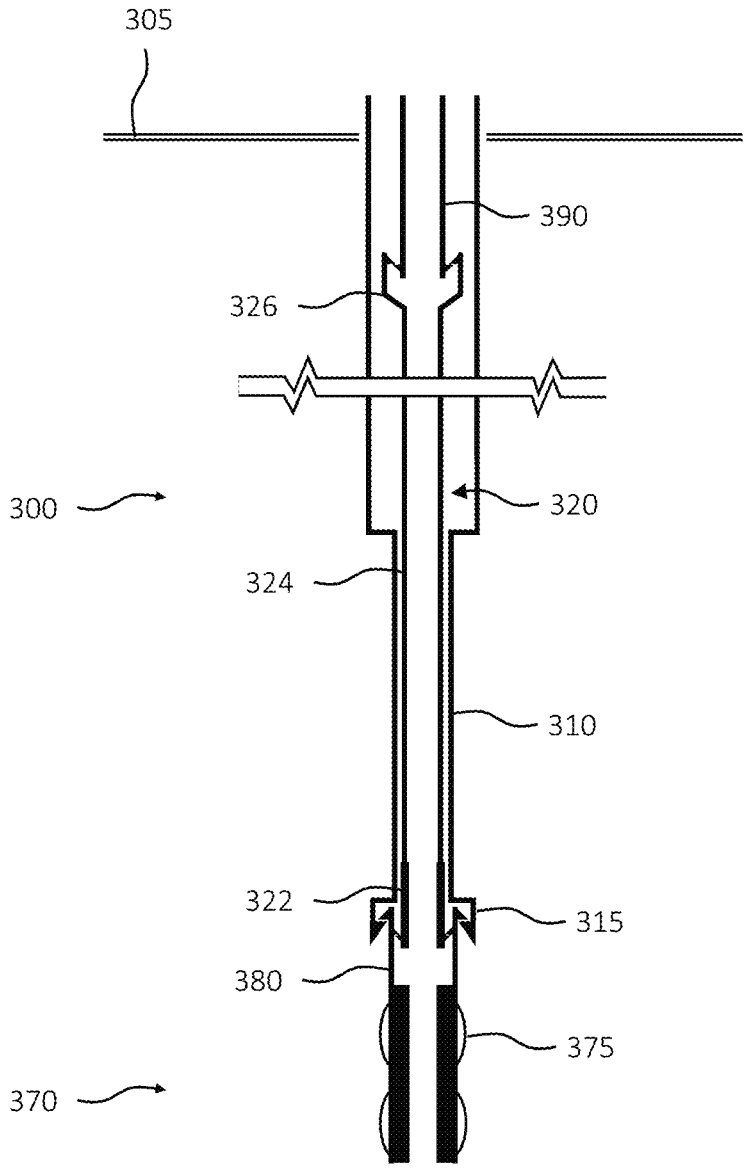

FIG. 3D illustrates the multi-zone completion assembly 305 of FIG. 3C after retrieving the fishing tool 390 uphole, thereby also retrieving the inner service tool string 320 at least partially uphole. As the inner service tool string 320 continues to be retrieved uphole, the casing scraper latch 380 associated with the casing scraper assembly 370 engages the packer assembly string latch 315 of the packer assembly string 310. What results is the casing scraper latch 380 becoming coupled to a lower end of the packer assembly string 310, as shown in FIG. 3D.

Figure 3E:
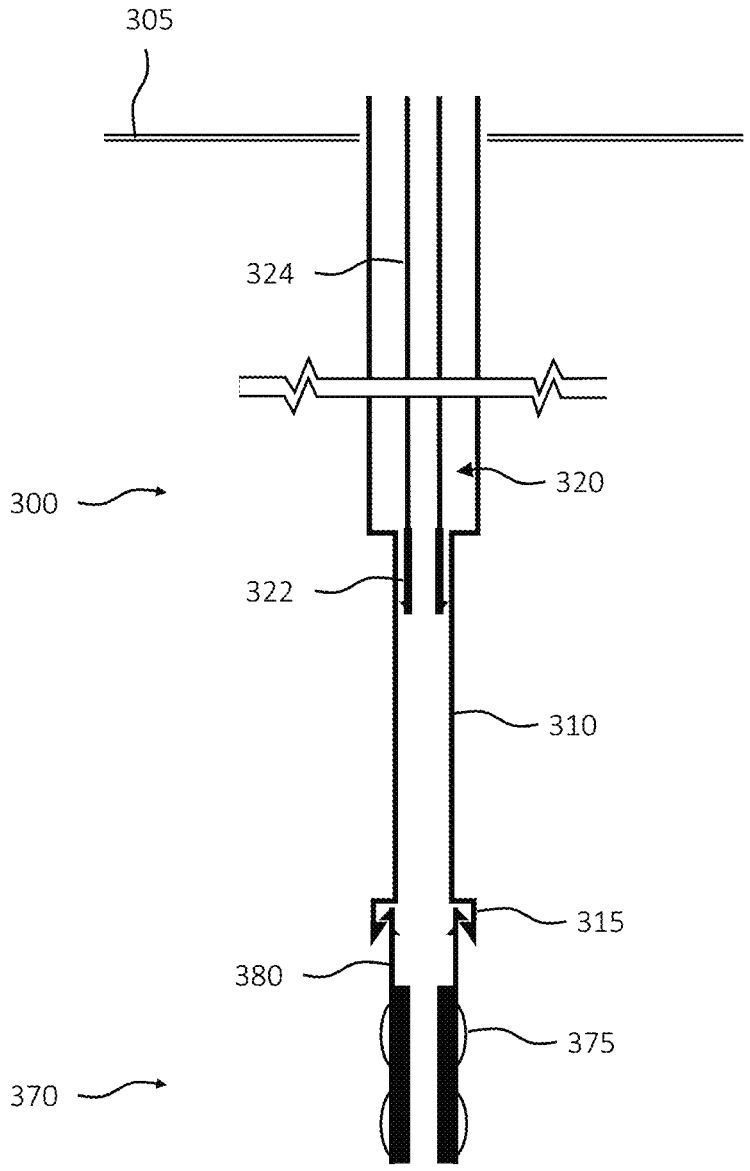

FIG. 3E illustrates the multi-zone completion assembly 305 of FIG. 3D after disconnecting the inner service tool string 320 from the casing scraper assembly 370, and then continuing to retrieve the inner service tool string 320 uphole, for example using the fishing tool 390. At this stage, the inner service tool string 320 is appropriately positioned within the packer assembly 310, and the entire multi-zone completion assembly 305 including the casing scraper assembly 370 may be run within the wellbore, for example using work string. In accordance with the disclosure, as the casing scraper assembly 370 is coupled to a lower end of the packer assembly 310, the casing scraper assembly 370 may remove debris and burrs from the wellbore casing prior to the packer assembly 310 encountering them.

Aspects disclosed herein include:

A. A method for deploying a multi-zone completion assembly, the method including: 1) coupling a casing scraper assembly to an inner service tool string hanging from a beginning section of a packer assembly suspended from a rig floor, the inner service tool string located within and extending below the beginning section of the packer assembly, and the casing scraper assembly located entirely below the beginning section of the packer assembly string; and 2) completing the packer assembly string from the rig floor as the inner service tool string and casing scraper assembly are hanging therefrom.

B. A downhole tool, the downhole tool including: 1) a multi-zone completion assembly, the multi-zone completion assembly including: 1) a packer assembly string having a packer assembly string latch proximate a downhole end thereof; b) an inner service tool string including an inner service tool positioned at least partially within the packer assembly string, the inner service tool string configured to slide within the packer assembly string; and 2) a casing scraper assembly having a casing scraper latch, the casing scraper latch engaged with the packer assembly string latch to couple the casing scraper assembly to a downhole end of the multi-zone completion assembly.

C. A well system, the well system including: 1) a wellbore extending into a subterranean formation; and 2) a downhole tool located within the wellbore, the downhole tool including: a) a multi-zone completion assembly, the multi-zone completion assembly including: i) a packer assembly string having a packer assembly string latch proximate a downhole end thereof; and ii) an inner service tool string including an inner service tool positioned at least partially within the packer assembly string, the inner service tool string configured to slide within the packer assembly string; and b) a casing scraper assembly having a casing scraper latch, the casing scraper latch engaged with the packer assembly string latch to couple the casing scraper assembly to a downhole end of the multi-zone completion assembly.

Aspects A, B, and C may have one or more of the following additional elements in combination: Element 1: further including running a fishing tool within the packer assembly string to engage the inner service tool string. Element 2: further including retrieving the inner service tool string toward the rig floor using the fishing tool until the casing scraper assembly engages with the packer assembly string. Element 3: wherein the inner service tool string includes a suspension tool proximate an upper end thereof, and further wherein the retrieving includes engaging the suspension tool with the fishing tool. Element 4: wherein the casing scraper assembly includes a casing scraper latch and the packer assembly string includes a packer assembly string latch, and further wherein the casing scraper latch engages with the packer assembly string latch. Element 5: wherein the casing scraper latch is a latch plug assembly and the packer assembly string latch is a latch plug receptacle. Element 6: further including running the packer assembly string having the casing scraper assembly engaged therewith within wellbore casing. Element 7: wherein the running includes scraping the wellbore casing with the casing scraper assembly. Element 8: wherein at least a portion of the inner service tool string remains within the packer assembly string during the running. Element 9: wherein the coupling the casing scraper assembly to the inner service tool string hanging from the beginning section of the packer assembly suspended from a rig floor includes extending a lower section of the inner service tool string within an inside diameter (ID) of the casing scraper assembly. Element 10: wherein the inner service tool string has an inner service tool for engaging with an inside diameter (ID) of the casing scraper latch to draw the casing scraper uphole and couple the casing scraper assembly to the downhole end of the multi-zone completion assembly. Element 11: wherein the casing scraper latch is a latch plug assembly and the packer assembly string latch is a latch plug receptacle. Element 12: wherein the casing scraper assembly includes one or more radially deployable scrapers. Element 13: wherein a maximum outside diameter ($OD_{Max}$) of the casing scraper assembly is greater than a minimum inside diameter ($ID_{Min}$) of the packer assembly string. Element 14: wherein the inner service tool string has an inner service tool for engaging with an inside diameter (ID) of the casing scraper latch to draw the casing scraper uphole and couple the casing scraper assembly to the downhole end of the multi-zone completion assembly. Element 15: wherein the casing scraper latch is a latch plug assembly and the packer assembly string latch is a latch plug receptacle. Element 16: wherein the casing scraper assembly includes one or more radially deployable scrapers. Element 17: wherein a maximum outside diameter ($OD_{Max}$) of the casing scraper assembly is greater than a minimum inside diameter ($ID_{Min}$) of the packer assembly string.

Those skilled in the art to which this application relates will appreciate that other and further additions, deletions, substitutions and modifications may be made to the described embodiments.

What is claimed is:

1. A method for deploying a multi-zone completion assembly, comprising:

coupling a casing scraper assembly to an inner service tool string hanging from a beginning section of a packer assembly string suspended from a rig floor, the inner service tool string located within and extending below the beginning section of the packer assembly string, and the casing scraper assembly located entirely below the beginning section of the packer assembly string;

completing the packer assembly string from the rig floor as the inner service tool string and casing scraper assembly are hanging therefrom; and running a fishing tool within the packer assembly string to engage the inner service tool string.

2. The method as recited in claim 1, further including retrieving the inner service tool string toward the rig floor using the fishing tool until the casing scraper assembly engages with the packer assembly string.

3. The method as recited in claim 2, wherein the inner service tool string includes a suspension tool proximate an upper end thereof, and further wherein the retrieving includes engaging the suspension tool with the fishing tool.

4. The method as recited in claim 2, wherein the casing scraper assembly includes a casing scraper latch and the packer assembly string includes a packer assembly string latch, and further wherein the casing scraper latch engages with the packer assembly string latch.

5. The method as recited in claim 4, wherein the casing scraper latch is a latch plug assembly and the packer assembly string latch is a latch plug receptacle.

6. The method as recited in claim 2, further including running the packer assembly string having the casing scraper assembly engaged therewith within wellbore casing.

7. The method as recited in claim 6, wherein the running includes scraping the wellbore casing with the casing scraper assembly.

8. The method as recited in claim 6, wherein at least a portion of the inner service tool string remains within the packer assembly string during the running.

9. The method as recited in claim 1, wherein the coupling the casing scraper assembly to the inner service tool string hanging from the beginning section of the packer assembly string suspended from a rig floor includes extending a lower section of the inner service tool string within an inside diameter (ID) of the casing scraper assembly.

10. A downhole tool, comprising:

a multi-zone completion assembly, the multi-zone completion assembly including:

a packer assembly string having a packer assembly string latch proximate a downhole end thereof; and an inner service tool string including an inner service tool positioned at least partially within the packer assembly string, the inner service tool string configured to slide within the packer assembly string;

a casing scraper assembly having a casing scraper latch, the casing scraper latch engaged with the packer assembly string latch to couple the casing scraper assembly to a downhole end of the multi-zone completion assembly; and a fishing tool located within the packer assembly string and engaged with the inner service tool string.

11. The downhole tool as recited in claim 10, wherein the inner service tool string has an inner service tool for engaging with an inside diameter (ID) of the casing scraper latch to draw the casing scraper uphole and couple the casing scraper assembly to the downhole end of the multi-zone completion assembly.

12. The downhole tool as recited in claim 10, wherein the casing scraper latch is a latch plug assembly and the packer assembly string latch is a latch plug receptacle.

13. The downhole tool as recited in claim 10, wherein the casing scraper assembly includes one or more radially deployable scrapers.

14. The downhole tool as recited in claim 10, wherein a maximum outside diameter ($OD_{Max}$) of the casing scraper assembly is greater than a minimum inside diameter ($ID_{Min}$) of the packer assembly string.

15. A well system, comprising:

a wellbore extending into a subterranean formation; and a downhole tool located within the wellbore, the downhole tool including:

a multi-zone completion assembly, the multi-zone completion assembly including:

a packer assembly string having a packer assembly string latch proximate a downhole end thereof; and an inner service tool string including an inner service tool positioned at least partially within the packer assembly string, the inner service tool string configured to slide within the packer assembly string;

a casing scraper assembly having a casing scraper latch, the casing scraper latch engaged with the packer assembly string latch to couple the casing scraper assembly to a downhole end of the multi-zone completion assembly; and a fishing tool located within the packer assembly string and engaged with the inner service tool string.

16. The well system as recited in claim 15, wherein the inner service tool string has an inner service tool for engaging with an inside diameter (ID) of the casing scraper latch to draw the casing scraper uphole and couple the casing scraper assembly to the downhole end of the multi-zone completion assembly.

17. The well system as recited in claim 15, wherein the casing scraper latch is a latch plug assembly and the packer assembly string latch is a latch plug receptacle.

18. The well system as recited in claim 15, wherein the casing scraper assembly includes one or more radially deployable scrapers.

19. The well system as recited in claim 15, wherein a maximum outside diameter ($OD_{Max}$) of the casing scraper assembly is greater than a minimum inside diameter ($ID_{Min}$) of the packer assembly string.

* * * * *